US007824465B2

(12) United States Patent
Larink, Jr.

(10) Patent No.: US 7,824,465 B2
(45) **Date of Patent: *Nov. 2, 2010**

(54) METHODS FOR PRODUCING METAL POWDERS

(75) Inventor: Steven C. Larink, Jr., Tucson, AZ (US)

(73) Assignee: Climax Engineered Materials, LLC, Phoenix, AZ (US)

( * ) Notice: Subject to any disclaimer, the term of this patent is extended or adjusted under 35 U.S.C. 154(b) by 191 days.

This patent is subject to a terminal disclaimer.

(21) Appl. No.: 12/169,794

(22) Filed: Jul. 9, 2008

(65) Prior Publication Data

US 2008/0264204 A1 Oct. 30, 2008

Related U.S. Application Data

(63) Continuation of application No. 11/092,023, filed on Mar. 29, 2005, now Pat. No. 7,470,307.

(51) Int. Cl.
*B22F 9/08* (2006.01)

(52) U.S. Cl. ..... 75/338; 75/355; 75/360

(58) Field of Classification Search ..... None
See application file for complete search history.

(56) References Cited

U.S. PATENT DOCUMENTS

| | | | | |
|---|---|---|---|---|
| 2,898,978 | A | | 8/1959 | Kitchen et al. |
| 3,071,463 | A | | 1/1963 | Hausner et al. |
| 3,592,395 | A | | 7/1971 | Lockwood et al. |
| 3,617,358 | A | | 11/1971 | Dittrich |
| 3,865,586 | A | | 2/1975 | Volin et al. |
| 3,909,241 | A | | 9/1975 | Cheney et al. |
| 4,028,095 | A | | 6/1977 | Laferty, Jr. et al. |
| 4,146,388 | A | | 3/1979 | Lafferty et al. |
| 4,221,614 | A | * | 9/1980 | Yoda et al. ..... 148/105 |
| 4,376,055 | A | | 3/1983 | Korosec et al. |
| 4,502,885 | A | | 3/1985 | Cheney |
| 4,592,781 | A | | 6/1986 | Cheney et al. |
| 4,613,371 | A | | 9/1986 | Cheney et al. |
| 4,622,068 | A | | 11/1986 | Rowe et al. |
| 4,670,047 | A | | 6/1987 | Kopatz et al. |
| 4,687,510 | A | | 8/1987 | Cheney et al. |
| 4,708,159 | A | | 11/1987 | Lockwood, Jr. |

(Continued)

FOREIGN PATENT DOCUMENTS

EP 1348669 1/2003

(Continued)

OTHER PUBLICATIONS

"Successful Tests: Materials Successfully Dried in PCS Dryers as of Jun. 2001, 161 Materials", Web page, Downloaded Mar. 28, 2005, http://www.pulsedry.com/materials.html (3 pages).

(Continued)

*Primary Examiner*—George Wyszomierski
(74) *Attorney, Agent, or Firm*—Fennemore Craig, P.C.

(57) ABSTRACT

A method for producing a metal powder product involves: Providing a supply of a precursor metal powder; combining the precursor metal powder with a liquid to form a slurry; feeding the slurry into a pulsating stream of hot gas; and recovering the metal powder product.

44 Claims, 7 Drawing Sheets

U.S. PATENT DOCUMENTS

| | | | | |
|---|---|---|---|---|
| 4,714,468 | A | 12/1987 | Wang et al. | |
| 4,767,313 | A | 8/1988 | Lockwood, Jr. | |
| 4,770,948 | A | 9/1988 | Oikawa et al. | |
| 4,778,519 | A | 10/1988 | Pesic | |
| 4,802,915 | A | 2/1989 | Kopatz et al. | |
| 4,819,873 | A | 4/1989 | Lockwood, Jr. | |
| 4,838,784 | A | 6/1989 | Lockwood, Jr. | |
| 4,941,820 | A | 7/1990 | Lockwood, Jr. | |
| 4,952,353 | A | 8/1990 | Neil | |
| 4,976,778 | A | 12/1990 | Berry et al. | |
| 4,976,779 | A | 12/1990 | Webwer et al. | |
| 4,992,039 | A | 2/1991 | Lockwood, Jr. | |
| 4,992,043 | A | 2/1991 | Lockwood, Jr. | |
| 5,037,705 | A | 8/1991 | Weber et al. | |
| 5,063,021 | A | 11/1991 | Anand et al. | |
| 5,082,710 | A | 1/1992 | Wright | |
| 5,124,091 | A | 6/1992 | Paliwal et al. | |
| 5,173,108 | A | 12/1992 | Houck | |
| 5,197,399 | A | 3/1993 | Mansour | |
| 5,252,061 | A | 10/1993 | Ozer et al. | |
| 5,255,634 | A | 10/1993 | Mansour | |
| 5,346,678 | A | 9/1994 | Phillips et al. | |
| 5,482,530 | A | 1/1996 | Hohne | |
| 5,523,048 | A | 6/1996 | Stinson et al. | |
| 5,626,688 | A | 5/1997 | Probst et al. | |
| 5,641,580 | A | 6/1997 | Sampath et al. | |
| 5,658,142 | A | 8/1997 | Kitchen et al. | |
| 5,842,289 | A | 12/1998 | Chandran et al. | |
| 6,022,395 | A | 2/2000 | Eckert et al. | |
| 6,102,979 | A | 8/2000 | Bianco et al. | |
| 6,114,048 | A | 9/2000 | Jech et al. | |
| 6,470,597 | B1 | 10/2002 | Stipp | |
| 6,548,197 | B1 | 4/2003 | Chandran et al. | |
| 6,593,213 | B2 | 7/2003 | Stanbery | |
| 6,733,562 | B2 | 5/2004 | Knunz et al. | |
| 7,250,076 | B2 | 7/2007 | Maze et al. | |
| 7,300,492 | B2 | 11/2007 | Singh et al. | |
| 7,470,307 | B2 * | 12/2008 | Larink, Jr. ..... | 75/345 |
| 2002/0134198 | A1 | 9/2002 | Edlinger | |
| 2002/0150528 | A1 | 10/2002 | Maus et al. | |
| 2004/0216558 | A1 | 11/2004 | Mariani | |
| 2005/0254987 | A1 | 11/2005 | Azzi et al. | |
| 2006/0051288 | A1 | 3/2006 | Tsurumi et al. | |
| 2006/0204395 | A1 | 9/2006 | Johnson | |
| 2007/0295390 | A1 | 12/2007 | Sheats et al. | |
| 2008/0057203 | A1 | 3/2008 | Robinson et al. | |

FOREIGN PATENT DOCUMENTS

| | | | |
|---|---|---|---|
| GB | 777591 | | 6/1957 |
| GB | 1347581 | | 2/1974 |
| GB | 2006264 | A | 5/1979 |
| JP | 5311212 | A | 11/1993 |
| SU | 1444077 | A1 | 12/1988 |

OTHER PUBLICATIONS

International Preliminary Report on Patentability dated Nov. 16, 2007 for PCT Application No. PCT/US2006/010883 (8 pages).

Examiner's Report for Great Britain Patent Application No. 0718170.4 dated Jan. 13, 2010, 3 pages.

John H. Scofield et al., Sodium Diffusion, Selenization, and Microstructural Effects Associated with Various Molybdenum Back Contact Layers for CIS-Based Solar Cells, 1995, pp. 164-167, Proc. of the 24th IEEE Photovoltaic Specialists Conference (IEEE, New York).

K. Ramanathan et al., Properties of 19-2% Efficiency ZnO/CdS/CuInGaSe2 Thin-film Solar Cells, Progress in Photovoltaics: Research and Applications, 2003, pp. 225-230, John Wiley & Sons, Ltd.

K. Ramanathan et al., Properties of High-Efficiency GIGS Thin-film Solar Cells, 2005, 7 pages, prepared for the 31st IEEE Photovoltaics Specialists Conference and Exhibition, Lake Buena Vista, Florida.

Jae Ho Yun et al., Fabrication of CIGS solar cells with a Na-doped Mo layer on a Na-free substrate, 2007, pp. 5876-5879, ScienceDirect, Thin Solid Films 515.

L.E. Moron et al., Abstract of Study of electrodeposition of molybdenum-tin alloys Monograph Title-ECS Transactions -Molecular Structure of the Solid-Liquid Interface and Its Relationship to Electrodeposition 5, Transactions Journal, 2007, 1 page, vol. 3.

International Search Report and Written Opinion of the International Searching Authority for PCT/US2009/30561 dated Mar. 10, 2009, 9 pages.

International Search Report and Written Opinion of the International Searching Authority for PCT/US2009/43992 dated Jun. 24, 2009, 9 pages.

Gil-Su Kim et al., Consolidation behavior of Mo powder fabricated from milled Mo oxide by hydrogen-reduction, Journal of Alloys and Compounds 454, 2008, pp. 327-330.

Roca Mining, Inc., Abstract of Drilling Intersects New Molybdenum Zone at MAX and Drilling Commences at Foremore VMS-Gold Project, 2008, 2 pages.

V.V. Kuznetsov et al., Abstract of Electrodeposition of chromium-molybdenum alloy from electrolyte based on chromium(III) sulfate, Russian Journal of Electrochemistry, 2008, 1 page.

James J. Martin et al., Abstract of Methodology for life testing of refractory metal/sodium heat pipes, Star Journal, 2006, 1 page, vol. 44, No. 16, NASA (Washington, D.C.).

C. Song et al., Abstract of Mo oxide modified catalysts for direct methanol, formaldehyde and formic acid fuel cells, Journal of Applied Electrochemistry, 2006, 1 page, Kluwer Academic Publishers (Netherlands).

F. Winterhalter et al., Abstract of Corrosion of Si3N4-MoSi2 ceramic composite in acid- and basic-aqueous environments: surface modification and properties degradation, Journal of Applied Surface Science, 2004, 1 page, vol. 225, No. 1-4 (Netherlands).

Vimal Desai et al., Abstract of Corrosion properties of MoSi2Si3N4 nanocomposite in acidic and basic aqueous environments, Meeting Abstract Journal, 2004, 2 pages.

Y.A. Shevchuk, Abstract of Correlation between Diffusion Parameters and the Temperature-Dependent Modulus of Elasticity of Metals, Inorganic Materials Journal, 2004, 1 page, vol. 40, No. 4 (New York, New York).

Charles L. Hussey et al., Abstract of Electrodeposition of Al-Mo alloys from the Lewis acidic aluminum chloride-1-ethyl-3-methylimidazolium chloride molten salt, Journal of Electrochemical Society, 2004, 1 page, vol. 151, No. 6.

Wan Jiang et al., Abstract of Effect of Na2O on mechanical properties of MoSi2 oxide composites for heating elements, Journal of Inorganic Materials, 2003, 1 page, vol. 18, No. 1.

Felicia Dragolici et al., Abstract of Obtainingsup 99 Mo-sup 99m Tc gel—generator based on zirconium molybdate, IFIN-HH Scientific Report, 2001, 2 pages (Romania).

K. Zou et al., Abstract of Photometric determination of high contents of silicon in aluminium alloys by the small alpha—silicon-molybdenum heteropoly acid method, Lihua Jianyan Huaxue Fence, 2001, 1 page, vol. 37, No. 11.

X. Zhang et al., Abstract of Pitting behavior of AI-3103 implanted with molybdenum, Journal of Corrosion Science 2001, 1 page, vol. 43, No. 1.

K.B. Kushkhov et al., Abstract of Investigation of mechanism of common electroreduction of dimolybdate, ditungstate ions and dioxide carbon on background of tungstate sodium melt, Rasplavy Journal, 2001, 1 page, vol. 6 (Russia).

Daniel P. Kramer et al., Abstract of Investigation of molybdenum -44.5%rhenium as cell wall material in an AMTEC based space power system, AIP Journal, 2000, 2 pages, vol. 504, No. 1 (United States).

A. Yoshikawa, Abstract of Single-crystal growth of a new sodium molybdenum bronze NaSUBOSUB. SUB8SUB6MoSUB5OSUB1SUB4, Journal of Materials Science Letters, 1997, 1 page, vol. 16, No. 8.

Noriyuki Sotani et al., Abstract of Preparation of hydrated potassium molybdenum bronzes and their thermal decomposition, Journal of Solid State Chemistry, 1997, 1 page, vol. 132, No. 2 (United States).
B.V. Cockeram et al., Abstract of Preventing the accelerated low-temperature oxidation of MoSi/sub 2/ (pesting) by the application of superficial alkali-salt layers, Journal of Oxidation of Metals, 1996, 1 page, vol. 45, Nos. 1-2 (United States).
J. Kloewer et al., Abstract of High temperature corrosion behavior of commercial high temperature alloys under deposits of alkali salts Monograph Title-Heat-resistant materials 2. Conference proceedings of the 2., international conference on heat-resistant materials,1995, 2 pages, ASM International (United States).
A.M. Huntz et al., Abstract of Effect of TeO sub 2 on the high temperature corrosion of Inconel 601, Cah. Inf. Tech. Rev. Metall. Journal, 1994, 1 page, vol. 91.
M. Casales et al., Abstract of Corrosion resistance of molybdenum silicides in aqueous solutions, Journal of Solid State Electrochem., 2005, 1 page, vol. 9, No. 10.
L.H. Hihara et al., Abstract of Polarisation behaviour and corrosion initiation mechanisms of Mo coated with amorphous hydrogenated silicon alloy thin ceramic films, Corros. Eng. Sci. Technol., 2004, 1 page, vol. 39, No. 4.
Takashi Suzuki et al., Abstract of Calorimetric study of hydrated sodium molybdenum bronze, Thermochimica Acta Journal, 2003, 1 page, vol. 406; Journal Issue: 1-2 (Netherlands).
P. Shuk et al., Abstract of Sodium ion sensitive electrode based on a molybdenum oxide bronze, Solid State Ionics Journal, 1996, 1 page, vol. 91, No. 3.
T.A. Kircher et al., Abstract of Performance of a Silicon-Modified Aluminide Coating in High Temperature Hot Corrosion Test Conditions, Surf. Coat. Technol., 1994, 1 page, vol. 68/69, Elsevier Science SA (Switzerland).
M. Kendig et al. Abstract of Cupric ion promotion of corrosion inhibition of molybdenum alloys by benzotriazole, 1994, 1 page, Electrochemical Society, Inc. (Pennington, New Jersey).
J.G. Kim et al., Abstract of Pitting and crevice corrosion of iron aluminides in a mild acid-chloride solution, Corrosion Journal, 1994, 1 page, vol. 50, No. 9 (United States).
M.A. Ryan et al., Abstract of Electrode, current collector, and electrolyte studies for AMTEC cells, American Institute of Physics, 1993, 1 page.
S. Colson et al., Abstract of Evaluation of the kinetic parameters of the sodium insertion in sodium molybdates by impedance spectroscopy, J. Electrochem. Soc., 1992, 1 page, vol. 139, No. 9 (United States).
E.F. Speranskaya et al., Abstract of Behaviour of amalgams of some d-metals during cathodic polarization in solutions, Elektrokhimiya Journal, 1982, 1 page, vol. 18, No. 2.
K.P. Tarasova et al., Abstract of Electrodeposition of Molybdenum and Molybdenum—Tungsten Alloys From Tungstate Molybdate Melts, Zashch. Met., 1981, 1 page, vol. 17, No. 3.
L.B. Koval et al., Abstract of Coprecipitation of Rhenium and Molybdenum With Tin Disulfide, Ukr. Khim. Zh., 1980, 1 page, vol. 46.
J. Jurczyk et al., Abstract of Contribution to the x-ray fluorescent analysis of ferroalloys employing the sample fusing technique, Hutnik, 1980, 1 page, vol. 47, No. 10 (Poland).
M.S. Gupalo et al., Abstract of Structure, Work Function, and Thermal Stability of Sodium Films on a (112) Face of Molybdenum, Soy Phys Solid State, 1980, 1 page, vol. 22, No. 11.
Anon, Abstract of Endako: Canada's Largest Molybdenum Producer, Can Min J, 1976, 1 page, vol. 97, No. 8.
O.M. Tatarinova et al., Abstract of Studying VM-1 molybdenum alloy workability at high current density, Elektron. Obrab. Mater., 1976, 1 page, No. 6 (Sudan).
Yu Andreev et al., Abstract of Kinetics of galvanodiffusive calorizing of molybdenum from a chloride salt melt, Prot. Met. (USSR) (Engl. Transl.), 1975, 1 page, vol. 11, No. 1 (United States).
F.X. McCawley et al., Abstract of Electrodeposition of Molybdenum Coatings, Electrochem Soc-J, 1969, 1 page, vol. 116.
G.P. Benediktova et al., Abstract of Diffusion of alkali metals in molybdenum and niobium (Diffusion of potassium and sodium in crystalline aggregates of molybdenum and niobium), Metallovedenie I, Termicheskaia Obrabotka Metallov, 1967, 1 page, Place Metal Science and Heat Treatment.
Margaret A. Ryan et al., Abstract of Electrode, current collector, and electrolyte studies for AMTEC cells, AEO Cambridge Scientific, 1993, 1 page.
Office Action filed by the United States Patent and Trademark Office for U.S. Appl. No. 12/169,916 dated May 12, 2010 (10 pages).
L.B. Lundberg et al., Abstract of Fabrication of high-temperature /1400-1700 K/ molybdenum heat pipes, 1980, vol. 1, 1 page, Proceedings of the Fifteenth Intersociety Energy Conversion Engineering Conference, Seattle, Washington.
R.E. Lindstrom et al., Abstract of Extraction of Molybdenum and Rhenium From Concentrates by Electrooxidation, 1 page.
C. Schlenker et al., Abstract of Low dimensional electronic properties and charge density waves in molybdenum bronzes Monograph Title-2034d American Chemical Society National Meeting, 1992, 2 pages, American Chemical Society (Washington, D.C.).
R.M. Williams et al., Abstract of Lifetime studies of high power rhodium/tungsten and molybdenum electrodes for application to AMTEC (alkali metal thermal-to-electric converter) Monograph Title-Proceedings of the 25th intersociety energy conversion engineering conference, vol. 2, 1990, 2 pages, American Institute of Chemical Engineers (New York, New York).
Shin-Ichi Ohfuji et al., Abstract of Reduction of Sodium Ion Density in Mo Gate Mos Devices by Ta Addition to Gate Electrodes, Electrochemical Society Extended Abstracts, 1984, 1 page, vol. 84.
C.P. Bankston et al., Abstract of Recent advanced in alkali metal thermoelectric converter (AMTEC) electrode performance and modeling, Proc. SPIE—Int. Soc. Opt. Eng., 1988, 1 page, vol. 871 (United States).
C.C. Nee et al., Abstract of Pulsed Electrodeposition of Ni-Mo Alloys, Journal of the Electrochemical Society, 1988, 1 page, vol. 135.
N.A. Amirkhanova et al., Abstract of Effect of preliminary plastic deformation on the anodic behavior of molybdenum -rhenium alloys, Protection of Metals, 1988, 1 page, vol. 23, No. 6 (United States).
R.M. Williams et al., Abstract of Effects of NaSUB2MoOSUB4 and NaSUB2WOSUB4 on molybdenum and tungsten electrodes for the alkali metal thermoelectric converter (AMTEC), Journal of the Electrochemical Society, 1988, 1 page, vol. 135, No. 11.
J.C. Dobson et al., Abstract of Corrosion of some metals in sulfur-polysulfide melts, Corros. Sci. 1988, 1 page, No. 10 (Great Britian).
G.B. Balazs et al., Abstract of Electrochemical studies of the corrosion of molybdenum electrodes in soda-lime glass melts, Journal of Non-Crystalline Solids, 1988, 1 page, vol. 105, No. 1.
H. Oikawa et al., Abstract of Development of High Purity Molybdenum Sputtering Target for VLSI Metallisation, Bull. Jpn. Inst. Met., 1987, 1 page, vol. 26.
Y. Miura et al., Abstract of Field-Assisted Reaction at Molybdenum—Molten Silicate Glass Interface—Effects of Additives Such as Fe sub 2 0 sub 3 , NiO, Cr sub 2 0 sub 3 and MnO sub 2, Journal of the Society of Materials Science, 1986, 1 page, vol. 35, No. 389 (Japan).
S. Mukhammedov et al., Abstract of Nondestructive Determination of Light Element Concentrations in Mo Powder Alloys Using Deuterons, Zavodskaya Laboratoriya. Diagnostika Materialov,1986, 1 page, No. 4 (Moscow).
D.M. Thomas et al., Abstract of Composition and proposed structure of the alkali metal layered molybdenum bronzes, Mater. Res. Bull., 1986, 1 page, vol. 21, No. 8 (United States).
N.D. Tomashov et al., Abstract of Protection of porous molybdenum from corrosion in distilled water with inhibiting additions of surfactants, Zashch. Met.,1985, 1 page, vol. 21, No. 1 (Sudan).
D.D. Gruich et al., Abstract of 0n possibility of determination of interaction potential from experiment on slow ions elastic scattering, Izy. Akad. Nauk SSSR, Ser. Fiz,, 1985, 1 page, vol. 49, No. 9 (Sudan).
V.E. Komarov et al., Abstract of Cathodic processes of platinum electrodes during Na sub 2 MoO sub 3-MoO sub 3 melt electrolysis, Soy. Electrochem. (Engl. Transl.),1985, 1 page, vol. 21, No. 3 (United States).

M. Greenblatt et al., Abstract of Quasi-two-dimensional electronic properties of the sodium molybdenum bronze, Na /SUB 0.9/ Mo sub 6 0 sub 1 sub 7, J. Solid State Chem., 1985, 1 page, vol. 59, No. 2 (United States).
K. LaGattuta et al., Abstract of Dielectronic recombination rates for ions of the sodium sequence, Physical Review A (General Physics), 1984, 1 page, vol. 30, No. 1 (United States).
Shin-Ichi Ohfuji et al., Abstract of Stabilization of Mo-Gate Mos Structures Using HSUB2 Doping in Mo and High Temperature Forming Gas Annealing, Journal of the Electrochemical Society, 1984, 1 page, vol. 131.

* cited by examiner

METHODS FOR PRODUCING METAL POWDERS

CROSS-REFERENCE TO RELATED APPLICATIONS

The present application is a continuation of nonprovisional application Ser. No. 11/092,023, filed Mar. 29, 2005, now U.S. Pat. No. 7,470,307. The application is hereby incorporated herein by reference as though fully set forth herein.

TECHNICAL FIELD

This invention relates to metal powders in general and more specifically to processes for producing metal powders.

BACKGROUND

Several different processes for producing powdered metal products have been developed and are currently being used to produce metal powders having certain characteristics, such as increased densities and increased flowabilities, that are desirable in subsequent metallurgical processes, such as, for example, sintering and plasma-spraying processes.

One process, known as plasma-based densification, involves contacting a metal precursor material with a hot plasma jet. The hot plasma jet liquefies and/or atomizes the metal in order to form small, generally spherically shaped particles. The particles are then allowed to re-solidify before being recovered. The resulting powdered metal product is often characterized by having a high flowability and high density, thereby making the powdered metal product desirable for use in subsequent processes (e.g., sintering and plasma-spraying).

Unfortunately, however, plasma-based densification processes are not without their drawbacks. For example, plasma-based densification processes tend to be expensive to implement, are energy intensive, and also suffer from comparatively low yields.

Another type of process, known as spray drying, involves a process wherein a solution or slurry containing the desired metal is rapidly dried to particulate form by atomizing the liquid in a hot atmosphere. One type of spray drying process for producing a powdered metal product utilizes a rotating atomizing disk provided in a heated process chamber. A liquid precursor material (e.g., a slurry or solution) containing a powdered metal material is directed onto the rotating disk. The liquid precursor material is accelerated generally outwardly by the rotating disk. The heated chamber speeds the evaporation of the liquid component of the liquid precursor material as the same is accelerated outwardly by the rotating disk. The resulting powdered metal end product is then collected from a perimeter wall surrounding the rotating disk.

While the foregoing spray drying process is often used to form a powdered metal product, it is not without its disadvantages. For example, spray drying processes also tend to suffer from comparatively low yields and typically result in a metal powder product having a lower density than is possible with plasma-based densification processes. Spray drying processes also involve fairly sizable apparatus (e.g., atomizing disks having diameters on the order of 10 m) and are energy intensive. The spray drying process also tends to be difficult to control, and it is not unusual to encounter some degree of variability in the characteristics of the powdered metal product, even though the process parameters remain the same. Such variability further increases the difficulty in producing a final powdered metal product having the desired characteristics.

Consequently, a need remains for a system capable of producing a powdered metal end product having characteristics, such as high density and high flowability, that make the powdered metal end product more desirable for use in subsequent applications. Ideally, such a system should be capable of producing increased yields of powdered metal end product, while at the same time involving less complexity, energy, and expense when compared to conventional processes.

SUMMARY OF THE INVENTION

A method for producing a metal powder product according to one embodiment of the invention may comprise: Providing a supply of a precursor metal powder; combining the precursor metal powder with a liquid to form a slurry; feeding the slurry into a pulsating stream of hot gas; and recovering the metal powder product.

Also disclosed is a metal powder product comprising agglomerated metal particles having a Hall flowability of less than about 30 seconds for 50 grams.

BRIEF DESCRIPTION OF THE DRAWINGS

Illustrative and presently preferred exemplary embodiments of the invention are shown in the drawings in which.

DETAILED DESCRIPTION

Figure 1:
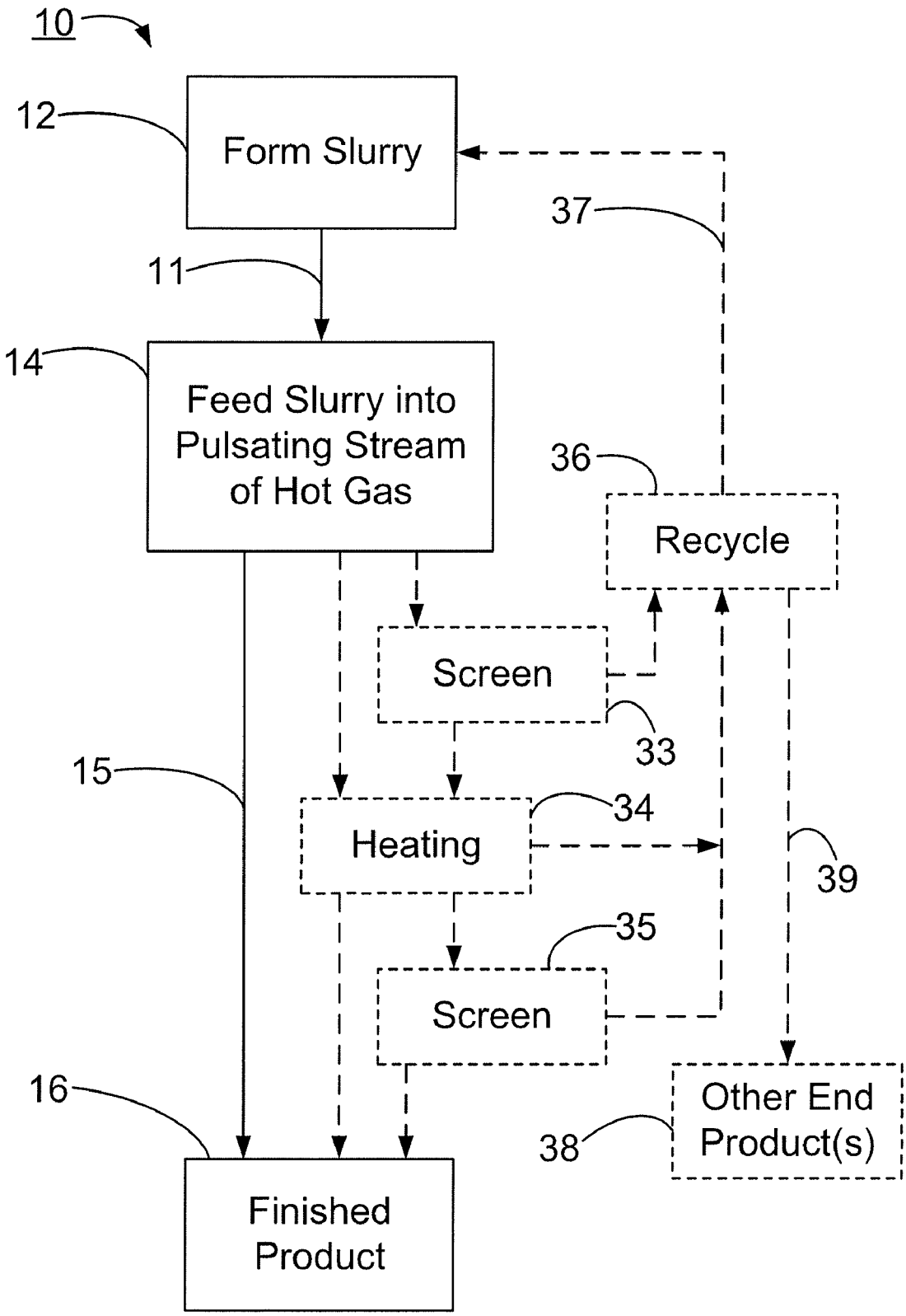
FIG. 1 is a flowchart depicting a method according to the invention(s) hereof.
Figure 2:
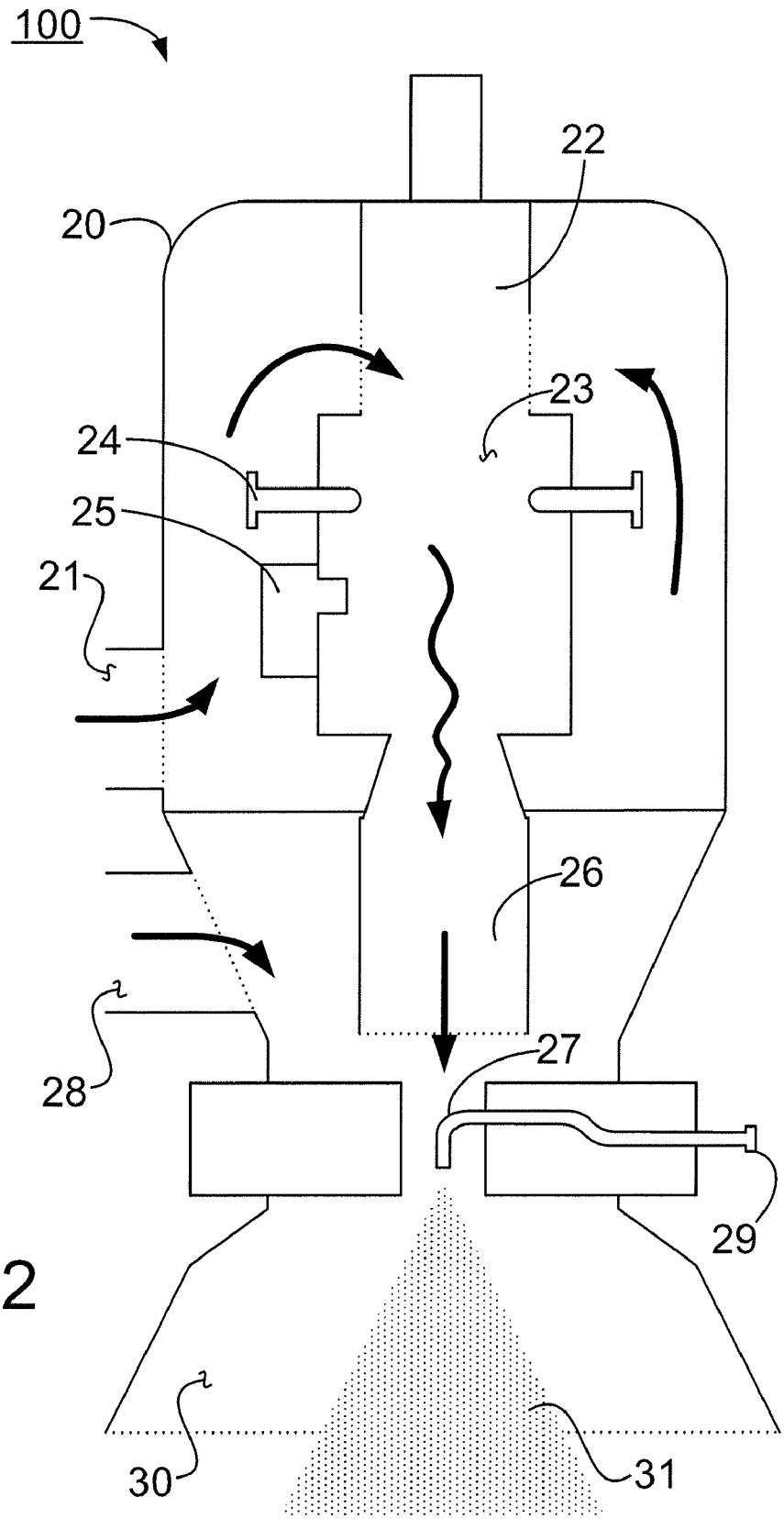
FIG. 2 is a sectional view of a pulse combustion system which may be used in and/or with the present invention.

A method 10 for producing a metal powder product is illustrated in FIG. 1 and comprises providing a supply of precursor metal powder and mixing the precursor metal powder with a liquid to form a slurry at step 12. The slurry is then fed into a pulsating stream of hot gas 14. In one embodiment, the pulsating stream of hot gas is produced by a pulse combustion system 100 (FIG. 2). The metal powder product is then recovered at step 16. As will be described in greater detail below, the recovered metal powder product comprises agglomerations of smaller particles having higher densities and higher flowabilities when compared to metal powders produced by conventional spray drying processes.

More specifically, a basic process hereof first includes the formation of a slurry at step 12 containing the precursor metal powder. In a typical example, the precursor metal powder is mixed with a liquid (e.g., water) to form the slurry, although other liquids, such as alcohols, volatile liquids, and organic liquids, may be used. In one embodiment, the liquid component of the slurry comprises a water and binder mixture which may initially be created by mixing together a binder, such as, for example, polyvinyl alcohol (PVA), and water. The precursor metal powder, such as, for example, a molybdenum powder (see the Examples set forth below), is then be added to the water/binder mixture to form the slurry.

It should be noted, however, that it may be necessary or desirable to pre-heat the liquid mixture before adding the precursor metal powder in order to ensure that the binder is fully dissolved in the liquid "carrier." The particular temperatures involved may depend to some degree on the particular liquid carrier (e.g., water) and binder (e.g., PVA) selected. Therefore, the present invention should not be regarded as limited to any particular temperature or range of temperatures for pre-heating the liquid mixture. However, by way of example, in one embodiment, the liquid mixture may be pre-heated to a temperature in a range of about 35° C. to about 100° C.

The slurry may comprise between about 60 to about 99 wt. % solids, such as about 60% to about 90% wt. % solids, and more preferably about 80% wt. % solids. The slurry may comprise between about 1 to about 40 wt. % liquid, such as about 10 to about 40 wt. % liquid, and more preferably about 20 wt. % liquid. The liquid component may comprise about 0.01 to about 5 wt. % binder, such as about 0.4 to about 0.9 wt. % binder, and more preferably about 0.7 wt. % binder. In one embodiment, the slurry comprises about 80 wt. % solids and about 20 wt. % liquid, of which about 0.7 wt. % is binder. The precursor metal powder may have sizes in a range of about sub-micron sizes (e.g., from about 0.25 μm to about 100 μm, such as about 1 μm to about 20 μm, and more preferably in a size range of about 5 μm to about 6 μm.

The slurry is then fed into a pulse combustion system 100 (FIG. 2) whereupon the slurry impinges a stream of hot gas (or gases), which are pulsed at or near sonic speeds. The sonic pulses of hot gas contact the slurry and drive-off substantially all of the water and form the metal powder product. The temperature of the pulsating stream of hot gas may be in a range of about 300° C. to about 800° C., such as about 427° C. to about 677° C., and more preferably about 600° C., although other temperatures may be used depending on the particular precursor metal powder being processed. Generally speaking, the temperature of the pulsating stream of hot gas is below the melting point of the precursor metal powder being processed. In addition, the precursor metal powder in the slurry is usually not in contact with the hot gases long enough to transfer a significant amount of heat to the metal powder. For example, in a typical embodiment, it is estimated that the slurry mixture is generally heated to a temperature in the range of about 93° C. to about 121° C. during contact with the pulsating stream of hot gas.

As will be described in greater detail herein, the resulting metal powder product comprises agglomerations of smaller particles that are substantially solid (i.e., non-hollow), and generally spherical in shape. Accordingly, the agglomerations may be generally characterized as "soccer balls formed of 'BBs'." In addition, the metal powder product comprises a high density and is highly flowable when compared to conventional metal powders produced by conventional processes. For example, molybdenum metal powders produced in accordance with the teachings herein may have Scott densities in a range of about 1 g/cc to about 4 g/cc, such as about 2.6 g/cc to about 2.9 g/cc. Hall flowabilities range from less than about 30 s/50 g to as low as 20-23 s/50 g for molybdenum metal.

With reference now primarily to FIG. 1, the method or process 10 for producing a metal powder product may comprise the making or forming of a slurry at step 12. Then, this slurry is exposed to a pulsating stream of hot gases at step 14, which yields desirable metal powder product at 16. The basic process is indicated by the solid line connection arrows 11 and 15 as opposed to the optional alternative process flows indicated by the dashed line arrows and boxes, generally identified by reference numerals 33-39, which are described below.

With reference now to FIG. 2, the pulsating stream of hot gases may be produced by a pulse combustion system 100 of the type that is well-known in the art and readily commercially available. By way of example, in one embodiment, the pulse combustion system 100 may comprise a pulse combustion system available from Pulse Combustion Systems of San Rafael, Calif., 94901. Initially, air may be fed (e.g., pumped) through an inlet 21 into the outer shell 20 of the pulse combustion system 100 at low pressure, whereupon it flows through a unidirectional air valve 22. The air then enters a tuned combustion chamber 23 where fuel is added via fuel valves or ports 24. The fuel-air mixture is then ignited by a pilot 25, creating a pulsating stream of hot gases which may be pressurized to a variety of pressures, e.g., about 2,000 Pa (3 psi) above the combustion fan pressure. The pulsating stream of hot gases rushes down the tailpipe 26 toward the atomizer 27. Just above the atomizer 27, quench air may be fed through an inlet 28 and may be blended with the hot combustion gases in order to attain a pulsating stream of hot gases having the desired temperature. The slurry is introduced into the pulsating stream of hot gases via the atomizer 27. The atomized slurry may then disperse in the conical outlet 30 in a general (though not necessarily) conical form 31 and thereafter enter a conventional tall-form drying chamber (not shown). Further downstream, the metal powder product may be recovered using standard collection equipment, such as cyclones and/or baghouses (also not shown).

In pulsed operation, the air valve 22 is cycled open and closed to alternately let air into the combustion chamber 23 and close for the combustion thereof. In such cycling, the air valve 22 may be reopened for a subsequent pulse just after the previous combustion episode. The reopening then allows a subsequent air charge to enter. The fuel valve 24 then re-admits fuel, and the mixture auto-ignites in the combustion chamber 23, as described above. This cycle of opening and closing the air valve 22 and combusting the fuel in the chamber 23 in a pulsing fashion may be controllable at various frequencies, e.g., from about 80 Hz to about 110 Hz, although other frequencies may also be used.

The pulse combustion system 100 thus provides a pulsating stream of hot gases into which is fed the slurry comprising the precursor metal powder. The contact zone and contact time are very short, the time of contact often being on the order of a fraction of a microsecond. Thus, the physical interactions of hot gas, sonic waves, and slurry produces the metal powder product. More specifically, the liquid component of the slurry is substantially removed or driven away by the sonic (or near sonic) pulse waves of hot gas. The short contact time also ensures that the slurry components are minimally heated, e.g., to levels on the order of about 93° C. to about 121° C. at the end of the contact time, temperatures which are sufficient to evaporate the liquid component, but are not near the melting point of the metal contained in the slurry.

In this process, some quantity of the liquid component (e.g., binder) remains in the resulting agglomerations of the metal powder product. The resulting powders may have this remaining binder driven off (e.g., partially or entirely), by a subsequent heating step 34. Generally speaking, heating step 34 is conducted at a temperature that is below the melting point of the metal powder product, thereby yielding a substantially pure (i.e., free of binder) metal powder product. It may also be noted that the agglomerations of the metal powder product preferably retain their shapes (in many cases, though not necessarily, substantially spherical), even after the binder is removed by heating step 34. Flowability data (Hall data) in heated and/or green forms are available (heated being after binder removal, green being pre-removal), as described relative to the Examples below.

Note further that in some instances, a variety of sizes of agglomerated products may be produced during this process, and it may be desirable to further separate or classify the metal powder product into a metal powder product having a size range within a desired product size range. For example, for molybdenum powder, sieve sizes of −200 to +325 U.S. Tyler mesh provide a metal powder product within a desired product size range of about 44 μm to 76 μm. A process hereof may yield a substantial percentage of product in this desired product size range; however, there may be remainder products, particularly the smaller products, outside the desired product size range which may be recycled through the system, see step 36, though liquid (e.g., water and binder) would again have to be added to create an appropriate slurry composition. Such recycling is shown as an optional alternative (or additional) step or steps in FIG. 1. These steps are shown particularly as the separation or screening step 33 with or without the additional heating and/or screening steps 34, 35 which may then feed any out-sized products (i.e., products either smaller or larger than the desired product size range) back to the recycling step 36, which in turn feeds back to the formation of a slurry step 12 as shown by arrow line 37. Alternatively, the results of the recycling step 36 can be the creation of or feed into alternative processes for the creation of other end products, see step 38 as fed thereby down arrow 39. These steps are shown also in FIGS. 3, 4 and 5 (in solid line form), and yet may be alternatives (as in FIG. 1) or may be primary steps in any one or more of the processes according hereto. Note, though not shown, the recycling process 36 can alternatively involve the feeding of one or more appropriate portions of the metal powder product of the combustion forming process back to the starting material step 40, see description thereof below, for in one example, size reduction by comminuting or jet milling.

The products hereof are also distinctive, as the powder particles in the post processing stage (i.e., after the hot gas contact step 14) are larger (i.e., plus or minus ten times (+/−10×) larger) than the starting materials (e.g., 5-6 μm for the precursor metal product vs. 44-76 μm for the metal powder product), but are combined in a manner not involving the melting of the precursor metal powder. Thus, the metal powder product comprises combinations or agglomerations of large numbers of smaller particles, each agglomeration being characterizable as a "soccer ball formed of 'BBs.'"

Figure 3:
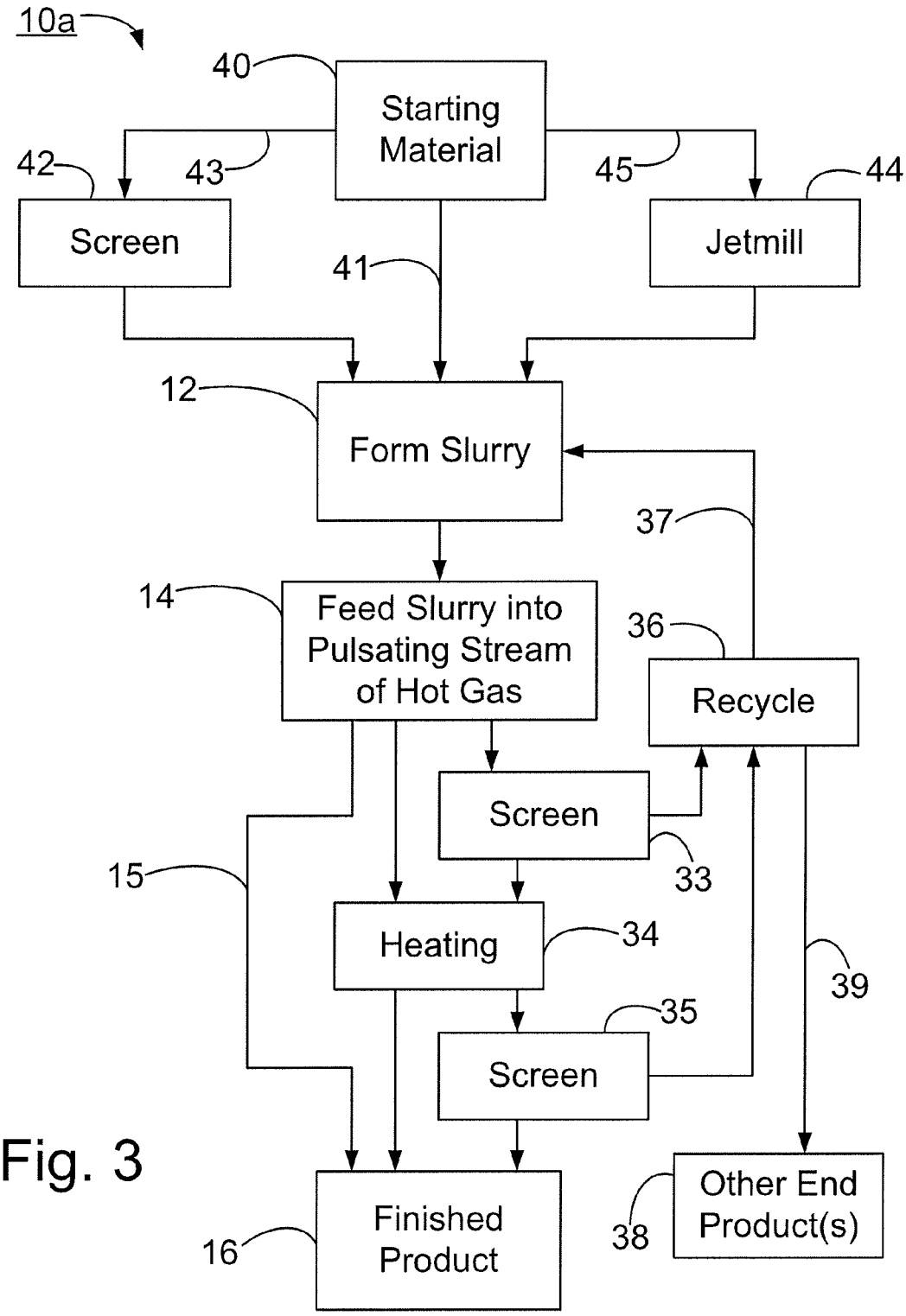
FIG. 3 is another flowchart depicting an alternative method according hereto.
Figure 4:
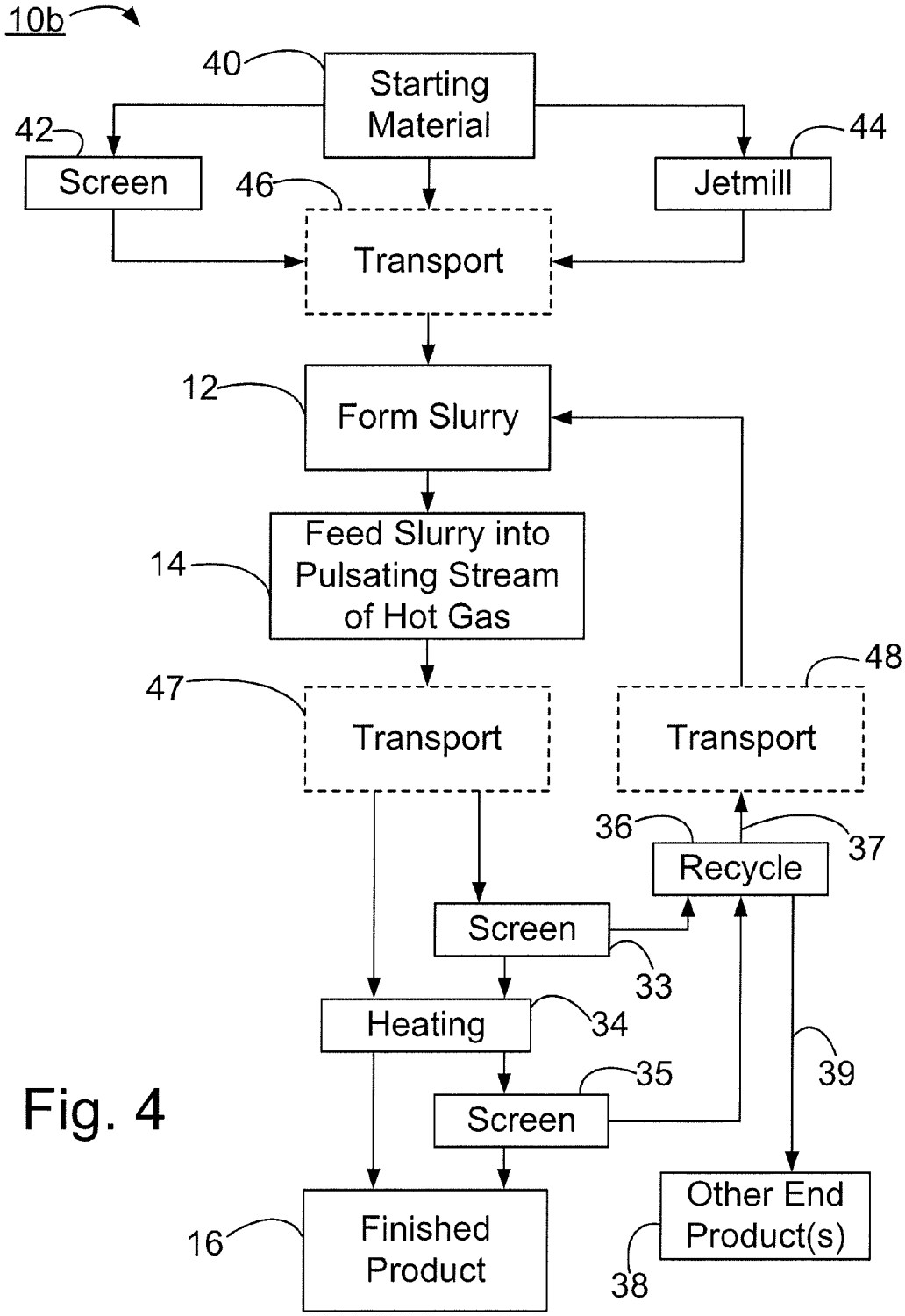
FIG. 4 is yet another flowchart depicting a further alternative method according hereto.
Figure 5:
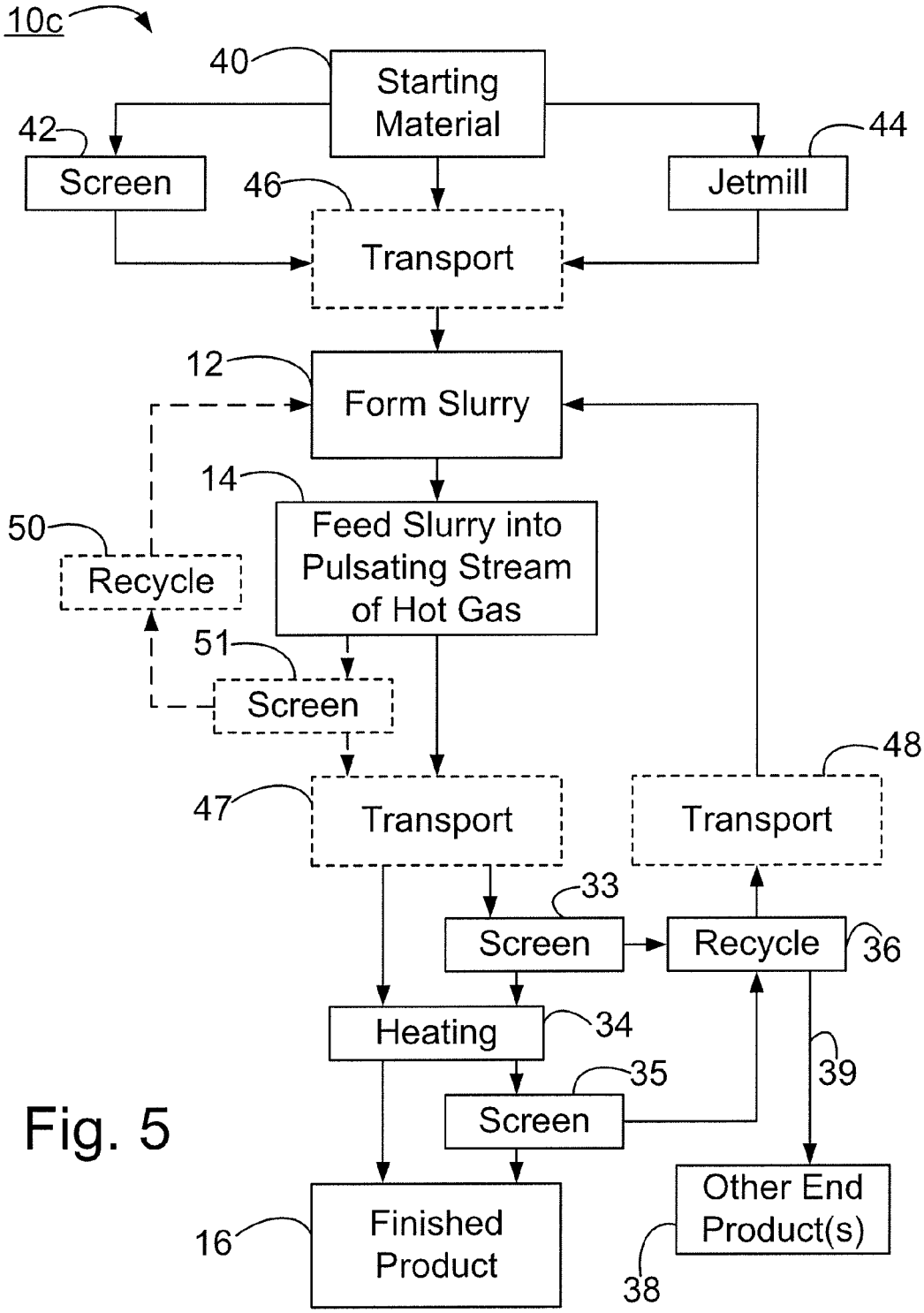
FIG. 5 is still another flowchart depicting yet one further alternative method according hereto.

Still further, it may be noted that additional pre- and/or post-processing steps may be added in some instances. For example, the precursor powder to be fed into the system may want some pre-processing to achieve a particular desired pre-processing size. Some such additional alternative steps are shown in FIGS. 3, 4 and 5, wherein the respective alternative processes 10*a*, 10*b* and 10*c* show the initial obtaining of a starting material at step 40, and from there either delivering this directly to the slurry making step, see arrow 41, or screening or jet milling the starting material, per steps 42 and/or 44 via alternative paths 43 and/or 45. As described further in the Examples below, a known, readily available precursor molybdenum powder having a size of about 14-15 μm may be used, though this may be preliminarily jet milled, see step 44, to the 5-6 μm size described herein.

FIGS. 4 and 5 present some additional alternative method steps which may provide additional utility and/or greater practicality. First, as shown in FIG. 4, three alternative additional steps for transportation, i.e., steps 46, 47 and 48, are shown. The purpose hereof may be based on the issue of the availability of pulse combustion system. More particularly, it may be necessary or desirable to transport the "raw" starting materials to the site of the pulse combustion system 100, per step 46, prior to the accomplishment of the other steps of the procedure. Note, it could also be that the slurry could be made at a location remote from the site of the pulse combustion system 100 as well so that the step 46 would instead be disposed between the "make slurry" step 12 and the "feed slurry into pulsating stream" step 14. A transport step 47 may then also be performed after the spraying step 14 is completed as is also shown by step 47 in FIG. 4. Then, any screening and/or heating, e.g., steps 33, 34, 35, could be performed if desired before achieving a metal powder product at step 16; although it is possible that such post-processing steps could alternatively be performed on site and thus the transport step 47 performed thereafter. If recycling is desired, a transport step 48 can be used to move recyclable powder particles back to the site of the pulse combustion system 100 to be re-formed into a slurry and re-introduced into the pulsating stream of hot gas. FIG. 5 adds two additional alternative steps 50 and 51 which provide for recycling, step 50, and/or screening, step 51, on-site at the location of the pulse combustion system 100.

It should be noted that the methods and apparatus described herein could be used to form a wide range of metal powder products from any of a wide range of precursor metal powders, including for example, substantially "pure" metals (e.g., any of a wide range of eutectic metals, non-eutectic metals and refractory metals), as well as mixtures thereof (e.g., metal alloys), understanding that in any alternative cases, certain modifications may be necessary (e.g., in temperatures, binders, ratios, etc.). This may be particularly so for either for the lower melting point materials as well as for the refractory metals (having high melting points). Thus, differing mixture quantities (solids to water to binder) and/or differing temperatures and/or feed speeds may be desirably and/or necessarily established. Otherwise, the processes and/or products may be substantially similar to those described here. Moreover, even though some metals or other dense materials may have relatively low melting points, it may also still be that the processes hereof may yet be productive therewith as well in that the extremely short contact times may be sufficient to create end-products without melting, or at least without an undesirable degree of melting (e.g., melting may be allowable if some degree of melting were followed by sufficiently quick cooling and/or re-solidification prior to either extreme agglomeration or sticking within the machinery). Different binders and/or suspension agents (i.e., alternatives to water) may also be found within the overall processes hereof, though again, perhaps indicating other changes in parameters (ratios, temperatures, speeds, for example).

EXAMPLES

Several examples according hereto have been run using molybdenum powder as a precursor metal powder having a size in a range of about 5-6 μm. As described herein, the first step involves the formation of a slurry at step 12, see FIGS. 1 and 3-5. In this instance, a water and binder mixture was first created. The resulting mixture was then heated to a temperature of about 71° C. (about 160° F.) to provide a desirable dispersion of binder in water, the binder in this first example being polyvinyl alcohol (PVA). The mixture was heated until the mixture was clear. The molybdenum precursor metal powder, comprising particles in a size range of about 5-6 μm, was then added to the heated water/binder mixture (which may be cooled before or during the adding of metal) and stirred to form a slurry comprising about 80 wt. % solids to about 20 wt. % water and binder liquids with an approximate 0.1 to about 1.0 wt. % of the total being binder (i.e., about 19 wt. % to about 19.9 wt. % water); about 0.4 wt. % to about 0.8 wt. % binder being preferred as described further below.

This slurry was then fed into a pulse combustion system 100 manufactured by Pulse Combustion Systems of San Rafael, Calif. 94901. The particular pulse combustion system 100 used had a thermal capacity of about 30 kW (about 100,000 BTU/hr) at an evaporation rate of about 18 kg/hour (about 40 lb/hour), whereupon the slurry was contacted by combustion gases produced by the pulse combustion system at step 14. The temperature of the pulsating stream of hot gases in this example was in the range of about 427° C. to about 677° C. (about 1050° F. to about 1250° F.). The pulsating stream of hot gases produced by the pulse combustion system 100 substantially drove-off the water to form the metal powder product. The contact zone and contact time were very short, the contact zone on the order of about 5.1 cm (about 2 inches) and the time of contact being on the order of 0.2 microseconds in this example.

The resulting metal powder product comprised agglomerations of smaller particles that were substantially solid (i.e., not hollow) and having generally spherical shapes. The metal powder product also had a comparatively high density and flowability when compared with conventional powders formed by conventional processes.

In this example, for molybdenum powder, the desired product size range was about 44 μm to about 76 μm, corresponding to sieve sizes of −200 to +325 U.S. Tyler mesh. The process yielded approximately 30 wt. % in this desired product size range. Metal powder product outside this size range was then recycled through the system with additional water and binder added to create the appropriate slurry composition. See FIGS. 1 and 3-5. Expanding the desired product size range somewhat, this example produced about 50 wt. % particles in sieve sizes of −100 to +325 U.S. Tyler mesh.

Note, pre- and/or post-procedures were also performed for these examples. Firstly, a known, readily available precursor molybdenum powder having particle sizes of about 14-15 μm was used, so it was first preliminarily jet milled, at step 44, to the 5-6 μm size described above. Also, the resulting metal powder product had remainder binder driven off (partially or entirely), by subsequent heating, see step 34, to about 1300° C. for molybdenum, which is still below the melting point of molybdenum. Post-processing screening was also performed to obtain the preferred mesh/sieve sizes. Smaller remainder products were, as mentioned, recycled.

Figure 6:
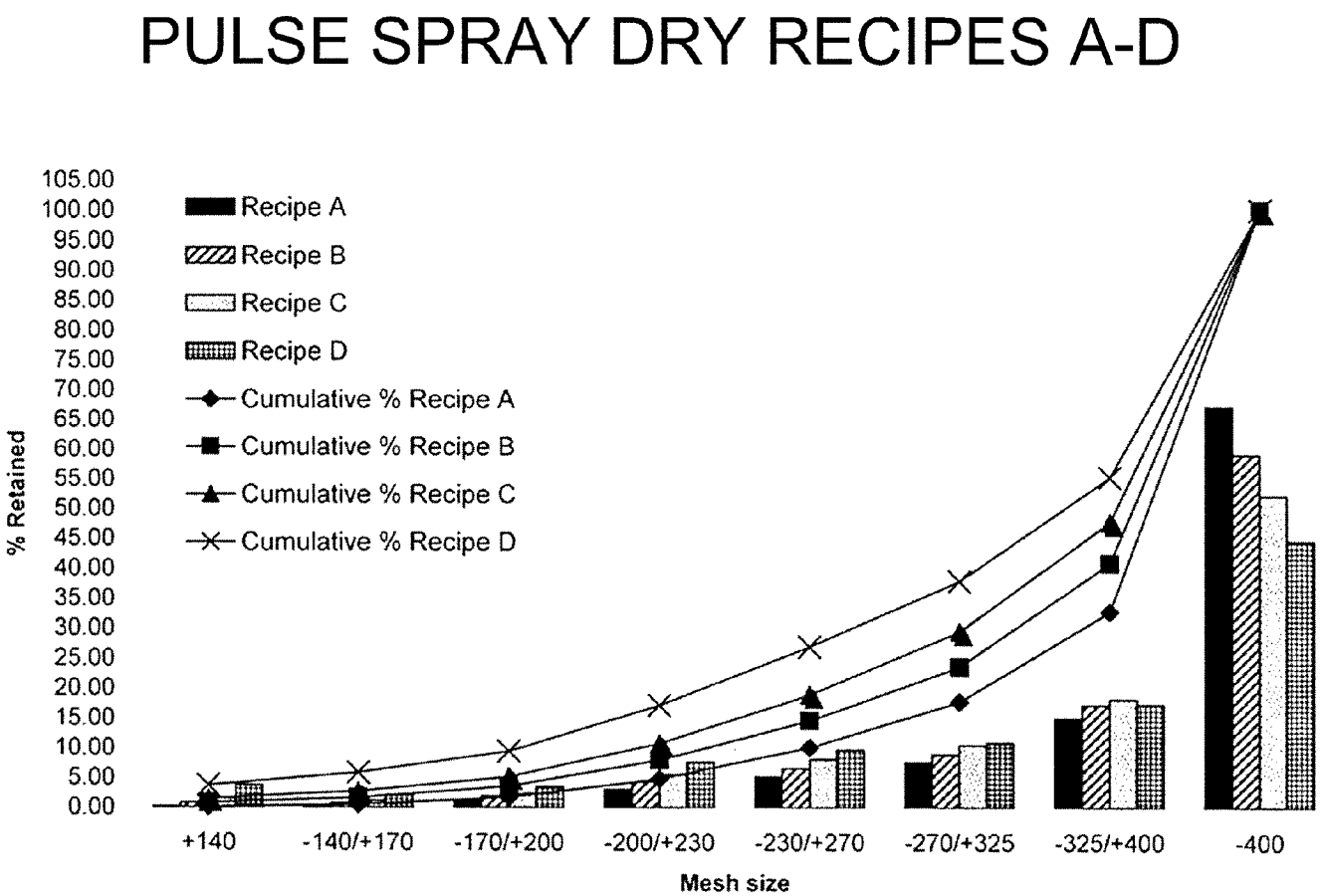
FIG. 6 is a graph showing the results of the practice of a method according hereto; and, FIG. 7 is a graph showing the results of the practice of a method according to the prior art.

The results of four exemplar runs according to this process are shown in FIG. 6, here arbitrarily designated as Recipes A, B, C and D. All four of these exemplar recipes were slurries made of about 80 wt. % solids (metal powders) and about 20 wt. % liquids, the variations being in the amount of binder; Recipe A having 0.5 wt. % PVA binder; Recipe B—0.6 wt. % PVA; Recipe C—0.7 wt. % PVA and Recipe D having 0.8 wt. % PVA; the remainders of the liquid portion being water. Then, what is shown for all four recipes run using the methods described herein are first very small amounts of large-size agglomerations, see the three left-hand columns representing U.S. Tyler mesh sizes +140; −140/+170; and −170/+200. The cumulative amounts of these large-size agglomerations are between about 2 and 10 percent of the total powders made for each batch. Next, in the three middle columns representing mesh sizes −200/+230; −230/+270; and −270/+325, are the accumulations of agglomerations in the sizes desired for the end-product molybdenum powders. The amounts of the desirable accumulations shown by these four examples are in the range of about 15 wt. % to about 30 wt. %. Recipe A provides the smaller amount, progressing through about 20 wt. % for Recipe B, about 25 wt. % for Recipe C and about 30 wt. % for Recipe D. Note, these accumulations are varied substantially directly based upon the differing amounts of binder added to the initial slurries. The last two columns reflect the amounts of smaller particles, agglomerations and/or un-reacted or substantially un-reacted metal powder elements passed through the process (between about 62 wt. % and about 82 wt. % in these examples). The highest binder content of these four samples, Recipe D, provides the largest realization percentage of desirable agglomerations. However, Recipe D also provides the highest amount of too-large agglomerations as well as the smallest amount of un-reacted particles. The lowest binder content (Recipe A) provided the least desirable size products, but also the least too-large agglomerations as well as the most un-reacted or substantially un-reacted particles. Based on the data for Recipes A, B, C, and D, it appears that a binder quantity of approximately between about 0.7-0.8 wt. % (e.g., about 0.75 wt. %) may provide one desirable optimization between desirable yields with favorable recyclability and satisfactory accumulations of the too-large agglomerations.

As mentioned, the larger binder quantity provides the larger amounts of oversized agglomerations, almost 10 wt. % for Recipe D. The smaller, un-reacted, or not quite large enough agglomerations can be simply recycled per step 36 in FIGS. 1 and 3-5.

Figure 7:
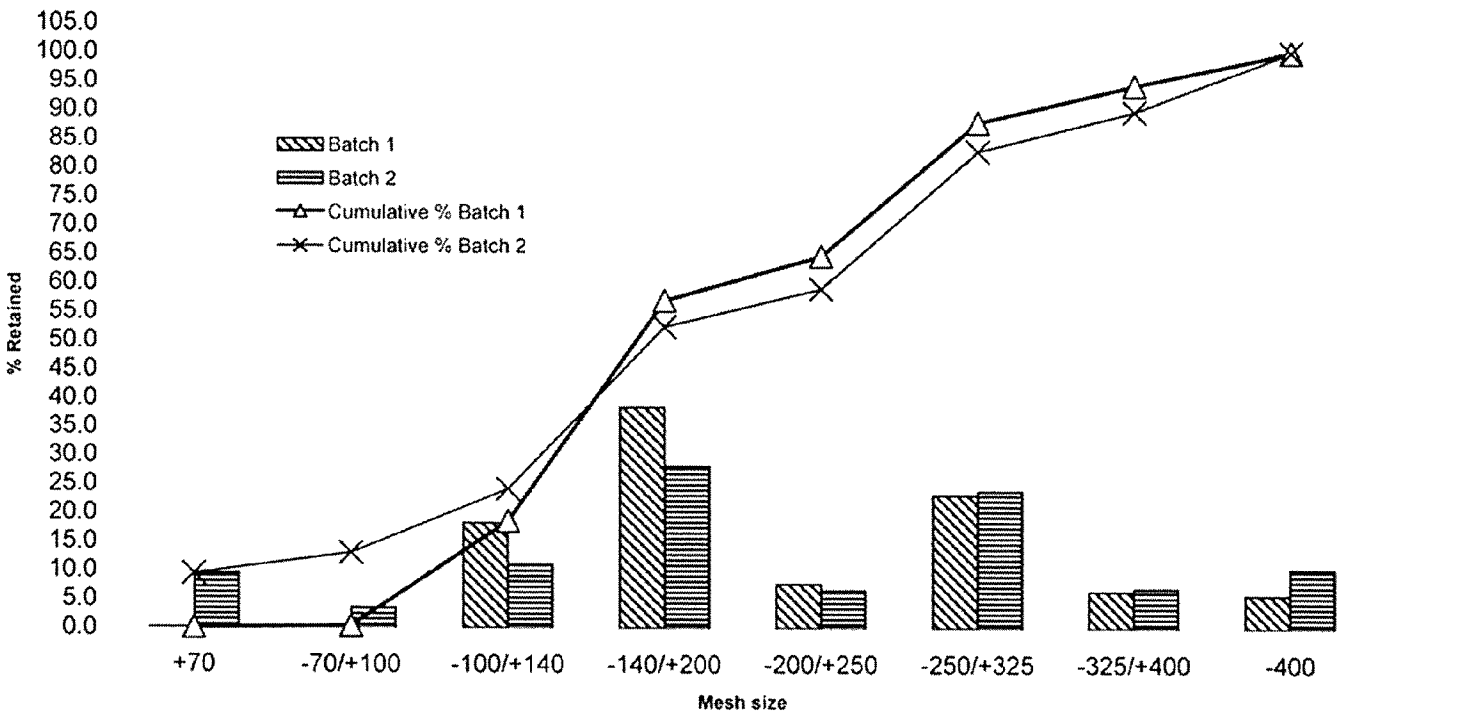
Fig. 7 Prior Art

In contrast, a typical conventional spray-drying method produced a powdered molybdenum metal product having the characteristics illustrated in FIG. 7. Briefly, the conventional spray-drying method involved a rotating atomizer disk contained in a heated atmosphere at a temperature of about 315° C. A slurry containing powdered molybdenum metal was then directed onto the rotating disk, whereupon it was accelerated generally outwardly by the rotating disk, the heated atmosphere serving to dry the molybdenum powder before being collected. As illustrated in FIG. 7, two batches of molybdenum metal powder are depicted as providing between about 52% and 57% of agglomerations in the first four columns thereof; these four columns providing oversized, large agglomerations outside the desired product size range. These also represent a substantial number of the hollow spheres described as a problem above. Moreover, the larger sizes also represent large wastes of binder. Further, this prior art process shows a bimodal operation in dropping to lower production amounts of the desired sizes, see the −200/+250 and the −250/+325 columns (although these two columns still account for product in the range of about 30% of the total), with small amounts of much smaller particles, see the −325/+400 and −400 column sizes.

Moreover, density and flow data are also favorable in the powders of the present invention. The respective batches 1 and 2 of the prior art process for forming molybdenum powders (whose sieve size results are shown in FIG. 7) had respective measured densities of about 1.8 and 1.9 g/cc on the Scott scale (the +325 powders being used for the density determinations). Additionally, the Hall flowability was on the order of about 50 s/50 g (50 seconds for the movement of 50 grams through a 0.1 inch orifice); batch 2 presenting about 53 seconds/50 g (again, the +325 powders being used for the flow determinations).

In comparison, the results of the four exemplar recipes of the present invention, on the other hand, presented higher densities of between about 2.75 and 2.9 g/cc apparent on the Scott scale; Recipe D having 2.75 g/cc; Recipe C—2.76 g/cc; Recipe B—2.83 g/cc; and Recipe A—2.87 g/cc; and, between about 2.67 and 2.78 g/cc apparent on the Scott scale; Recipe D having 2.67 g/cc; Recipe C—2.71 g/cc; Recipe B—2.77 g/cc; and Recipe A—2.78 g/cc. These greater densities of the present invention may be due primarily to the lack of hollow spheres as are found in the prior art spray-drying processes. Moreover, such densities are favored because this means more metal is available in a given volume of powder; more metal to be more efficiently used in any subsequent process using the end product powder hereof (as in coating processes, for example).

Furthermore, the Hall flowability results of the powders of the current invention also indicated a highly flowable metal powder product, ranging from about 20 s/50 g to about 22.3 s/150/g; more particularly, Recipe A—20.00 s/50 g; Recipe B—20.33 s/50 g; Recipe C—21.97 s/50 g; and Recipe D—22.28 s/50 g. These much faster flow rates also mean greater efficiency in any use of the metal powder product of the present invention.

It may also be noted that these data from the runs of Recipes A-D and the prior art batches 1 and 2 (see FIGS. 6 and 7 as well as the density and flow data above), was derived from the end product powders emerging from the pulse combustion machinery in green form (e.g., before performing optional heating step 34). Nevertheless, subsequent heating (e.g., at optional step 34) does not affect these results in any substantial way. The prior art spray-drying process still results in bi-modal outputs with substantially insignificant changes in density or flowability, while the present process continues to present Gaussian yield distributions with no significant changes in density or flowability.

In sum, the charts of FIGS. 6 and 7 and these density and flowability data show some of the advantages of the present invention. First, there is a bimodal distribution with conventional spray drying, see FIG. 7 and the above description. Although this bimodal distribution does partially land within the wanted material area, the present invention provides material that is Gaussian in the wanted area and not bi-modal, see FIG. 6. The distribution of the present invention may also be viewed as having a second curve (though it could still be considered Gaussian as shown here) outside the desired mesh sizes for the smaller particles; however, this second or extension of the curve representing the less than desirable end-product is comprised of substantially un-reacted material. This is unlike the non-Gaussian/bi-modal conventional spray drying process that rather demonstrates the yielding of material that is completely reacted, and too large for recycling. Moreover, the data from Recipes A-D show that the Gaussian curve in the wanted product region may be easily moved using different binder quantities. The chart of FIG. 6 shows that using higher levels of binder yields more reacted product and a shifting of the reacted product toward larger particles, see particularly Recipe D. The present invention also results in tighter yield distribution. This is a tighter distribution curve in usable area compared to bimodal curve from traditional spray drying of molybdenum.

Additionally, there are several advantages in the usual preferred reduction of the binder content in the present invention compared to conventional spray drying processes. Conventional spray drying generally uses about 1 wt. % binder compared to some of the preferred amounts of between about 0.1 wt. % to about 0.9 wt. %, including the 0.5 wt. % to 0.8 wt. % demonstrated ranges for molybdenum powder-200/+325 U.S. Tyler mesh. Indeed, often the higher binder amounts in the area of 1 wt. % can provide less desirable stickiness in the present process impacting flowability among other effects. Still furthermore, this lower binder content of the present invention processes yields higher purity products in the finished product powders due to fewer impurities being introduced at the beginning. Thus, the end-product materials produced here are of higher qualities/purities and have improved properties compared to those produced using conventional spray drying. The data shows flow time decreases (i.e., speedier flow rates equals decreased flow times) and density increases (no or at least substantially less hollow agglomerations) compared to conventional spray dried material.

Having herein set forth preferred embodiments of the present invention, it is anticipated that suitable modifications can be made thereto which will nonetheless remain within the scope of the invention. The invention shall therefore only be construed in accordance with the following claims:

The invention claimed is:

1. A method for producing a metal powder product, comprising:

providing a supply of a precursor metal powder;

combining said precursor metal powder with a liquid to form a slurry;

atomizing said slurry;

contacting said atomized slurry with a pulsating stream of hot gas to produce the metal powder product;

and recovering the metal powder product.

2. The method of claim 1, wherein said liquid comprises water.

3. The method of claim 1, wherein combining said precursor metal powder with a liquid to form a slurry further comprises combining said precursor metal powder with a liquid and a binder to form a slurry.

4. The method of claim 3, wherein said liquid comprises water and wherein said binder comprises polyvinyl alcohol.

5. The method of claim 3, wherein said slurry comprises between about 60% to about 99% by weight metal powder material.

6. The method of claim 3, wherein said slurry comprises between about 0.01% to about 5% by weight binder.

7. The method of claim 1, wherein providing a supply of precursor metal powder comprises providing a supply of precursor metal powder selected from the group consisting of a metal powder, a metal alloy powder, and mixtures thereof.

8. The method of claim 1, wherein providing a supply of precursor metal powder comprises providing a supply of precursor metal powder selected from the group consisting of a eutectic metal powder, a refractory metal powder, and mixtures thereof.

9. The method of claim 1, wherein providing a supply of precursor metal powder comprises providing a supply of precursor metal powder having sizes in a range of about 0.25 μm to about 100 μm.

10. The method of claim 1, wherein providing a supply of precursor metal powder comprises providing a supply of precursor metal powder having sizes in a range of about 1 μm to about 20 μm.

11. The method of claim 1, wherein providing a supply of precursor metal powder comprises providing a supply of molybdenum metal powder.

12. The method of claim 1, further comprising separating said metal powder product into a first powder metal product having a size range within a desired product size range.

13. The method of claim 12, further comprising re-cycling said metal powder product having sizes outside the desired product size range.

14. The method of claim 12, wherein said desired product size range comprises a range of about 10 μm to about 100 μm.

15. The method of claim 12, wherein said desired product size range comprises a range of about 44 μm to about 76 μm.

16. The method of claim 1, wherein said contacting comprises contacting said atomized slurry with a pulsating stream of hot gas having a temperature in a range of about 300° C. to about 800° C.

17. The method of claim 1, wherein said contacting comprises contacting said atomized slurry with a pulsating stream of hot gas having a temperature in a range of about 427° C. to about 677° C.

18. The method of claim 1, wherein the hot gas is pulsed at about a sonic velocity.

19. The method of claim 1, wherein said contacting said atomized slurry with a pulsating stream of hot gas includes partially melting at least some of the precursor metal powder product and further comprising allowing the partially melted precursor metal product to re-solidify before recovering the metal powder product.

20. The method of claim 1, wherein said contacting said atomized slurry with a pulsating stream of hot gas includes completely melting at least some of the precursor metal powder product and further comprising allowing the completely melted precursor metal product to re-solidify before recovering the metal powder product.

21. A method for producing a metal powder product, comprising:

providing a supply of a precursor metal powder;

combining said precursor metal powder with a liquid to form a slurry;

creating a pulsating stream of hot gas;

atomizing the slurry in the pulsating stream of hot gas to produce the metal powder product;

and recovering the metal powder product.

22. The method of claim 21, further comprising attaining a desired temperature of the pulsating stream of hot gas by blending quench air with the pulsating stream of hot gas before atomizing the slurry.

23. The method of claim 21, further comprising at least partially driving off a liquid component of the recovered metal powder product.

24. The method of claim 23, wherein the at least partially driving off a liquid component includes heating the recovered metal powder product at a temperature below the melting point of the recovered metal powder product.

25. A method for producing a metal powder product, comprising:

providing a supply of a precursor metal powder;

combining said precursor metal powder with a liquid to form a slurry;

creating a pulsating stream of hot gas;

blending quench air with the pulsating stream of hot gas to create a pulsating stream of hot gas having a desired temperature;

atomizing the slurry in the pulsating stream of hot gas having a desired temperature to produce the metal powder product; and recovering the metal powder product.

26. The method of claim 25, wherein creating a pulsating stream of hot gas comprises creating a pulsating stream of hot gas that pulsates at a frequency in a range of about 80 Hz to about 110 Hz.

27. The method of claim 25, wherein said blending quench air comprises blending sufficient quench air with the pulsating stream of hot gas to produce a pulsating stream of hot gas having a desired temperature in a range of about 300° C. to about 800° C.

28. A method for producing a molybdenum metal powder product, comprising:

providing a supply of a precursor molybdenum metal powder;

combining said supply of precursor molybdenum metal powder with a liquid to form a slurry;

creating a pulsating stream of hot gas;

blending quench air with the pulsating stream of hot gas to create a pulsating stream of hot gas having a desired temperature of at least about 300° C.;

atomizing the slurry in the pulsating stream of hot gas having a desired temperature to produce the molybdenum metal powder product; and recovering the molybdenum metal powder product.

29. The method of claim 28, wherein said blending comprises blending quench air with the pulsating stream of hot gas to create a pulsating stream of hot gas having a desired temperature in a range of about 300° C. to about 800° C.

30. The method of claim 28, wherein said blending comprises blending quench air with the pulsating stream of hot gas to create a pulsating stream of hot gas having a desired temperature in a range of about 427° C. to about 677° C.

31. The method of claim 28, wherein said blending comprises blending quench air with the pulsating stream of hot gas to create a pulsating stream of hot gas having a desired temperature of about 600° C.

32. The method of claim 28, wherein said combining comprises combining said supply of precursor molybdenum metal powder with sufficient liquid so that the slurry comprises at least about 60% by weight molybdenum metal.

33. The method of claim 28, wherein said combining comprises combining said supply of precursor molybdenum metal powder with sufficient liquid so that the slurry comprises in a range of about 60% by weight to about 90% by weight molybdenum metal.

34. The method of claim 28, wherein said combining comprises combining said supply of precursor molybdenum metal powder with sufficient liquid so that the slurry comprises about 80% by weight molybdenum metal.

35. The method of claim 28, wherein said combining comprises combining said supply of precursor molybdenum metal powder with water to form a slurry.

36. The method of claim 28, wherein said combining comprises combining said supply of precursor molybdenum metal powder with water and a binder to form a slurry.

37. The method of claim 36, wherein said combining comprises combining said supply of precursor molybdenum metal powder with water and sufficient binder so that said slurry comprises less then about 5% by weight binder.

38. The method of claim 36, wherein said combining comprises combining said supply of precursor molybdenum metal powder with water and sufficient binder so that said slurry comprises in a range of about 0.1% to about 5% by weight binder.

39. The method of claim 36, wherein said combining comprises combining said supply of precursor molybdenum metal powder with water and sufficient binder so that said slurry comprises in a range of about 0.4% to about 0.9% by weight binder.

40. The method of claim 36, wherein said combining comprises combining said supply of precursor molybdenum metal powder with water and sufficient binder so that said slurry comprises about 0.7% by weight binder.

41. The method of claim 28, wherein said combining comprises combining said supply of precursor molybdenum metal powder with water and polyvinyl alcohol to form a slurry.

42. The method of claim 28, wherein said providing comprises providing a supply of a precursor molybdenum metal powder having a size in a range of about 0.25 μm to about 100 μm.

43. The method of claim 28, wherein said providing comprises providing a supply of a precursor molybdenum metal powder having a size in a range of about 1 μm to about 20 μm.

44. The method of claim 28, wherein said providing comprises providing a supply of a precursor molybdenum metal powder having a size in a range of about 5 μm to about 6 μm.

* * * * *